US005788153A

United States Patent [19]

Ortwein

[11] Patent Number: 5,788,153

[45] Date of Patent: Aug. 4, 1998

[54] INFRASTRUCTURE FOR RAILWAY TRACKS

[76] Inventor: Hermann Ortwein, Mühlenweg 25, D-51588 Nümbrecht, Germany

[21] Appl. No.: 776,281

[22] PCT Filed: Jul. 22, 1995

[86] PCT No.: PCT/EP95/02906

§ 371 Date: Jan. 14, 1997

§ 102(e) Date: Jan. 14, 1997

[87] PCT Pub. No.: WO96/04425

PCT Pub. Date: Feb. 15, 1996

[30] Foreign Application Priority Data

Aug. 2, 1994 [DE] Germany ..... 44 27 237.5

[51] Int. Cl.[6] ..... E01B 1/00

[52] U.S. Cl. ..... 238/7

[58] Field of Search ..... 238/6, 7, 8, 264

[56] References Cited

U.S. PATENT DOCUMENTS

| | | | |
|---|---|---|---|
| 3,417,921 | 12/1968 | Maynier | 238/264 |
| 4,793,545 | 12/1988 | Raymond | 238/8 |
| 5,538,182 | 7/1996 | Davis et al. | 238/8 |
| 5,609,294 | 3/1997 | Lucas, Jr. | 238/8 |

FOREIGN PATENT DOCUMENTS

| | | | |
|---|---|---|---|
| 258035 | 7/1988 | Denmark | 238/8 |
| 2 106 249 | 4/1972 | France . | |
| 291590 | 4/1916 | Germany . | |
| 23 54 958 | 5/1975 | Germany . | |
| 29 01 283 | 7/1980 | Germany . | |
| 87 11 451 U | 2/1989 | Germany . | |
| 40 27 836 | 3/1992 | Germany . | |
| 2622 | 12/1915 | Netherlands . | |
| 468 182 | 6/1937 | United Kingdom . | |

*Primary Examiner*—S. Joseph Morano
*Attorney, Agent, or Firm*—Herbert Dubno; Yuri Kateshov

[57] ABSTRACT

An infrastructure for railway tracks with continuous elastic support has two rails forming the track supported via elastic intermediate layers with their lateral limiting surfaces located underneath the rail head against the inner lateral limiting surfaces of a frame consisting of two frame halves and underneath each rail a longitudinal plate consisting of concrete. One of the frame halves rests against a first lateral wall of a trough while the other frame half rests via a wedge against the second lateral wall of the trough.

12 Claims, 2 Drawing Sheets

INFRASTRUCTURE FOR RAILWAY TRACKS

SPECIFICATION

CROSS REFERENCE TO RELATED APPLICATIONS

This application is a National Phase Application of PCT/EP95/02906 filed 22 Jul. 1995 and based, in turn, on German National Application P 44 27 237.5 filed 2 Oct. 1994 under the International Convention.

1. Field of the Invention

The invention relates to an infrastructure for railway tracks with continuous elastic support, whereby the two rails forming the track are supported, via elastic intermediate layers, with their lateral limiting surfaces located underneath the rail head against the inner lateral surfaces of a frame consisting of two frame halves and whereby under each rail a longitudinal concrete sleeper is provided.

2. Background of the Invention

As a rule tracks for rail vehicles are laid on beds, grit or compacted and optionally reinforced soil, on embankments of compacted material or on concrete plates, which lie directly on the ground (DE-OS 29 01 283, DE-OS 23 54 958). Such tracks are also frequently laid on gravel. The soil, as well as the gravel are, elastic within certain limits, thus forming a spring cushion which provides a minor damping of the impact noise.

When in tracks laid out in the above manner elastically supported rails are used for further reduction of the vibrations resulting from the vehicle movements on the tracks and the related impact noise, a frequency at which the elastic rail support acting as a spring vibrates rather increases the noise generated by the vehicle's movement.

Further, an infrastructure is known wherein under each rail of the track a longitudinal sleeper is provided, consisting of a continuous rigid girder (DE-OS 40 27 836). Due to this construction of the infrastructure, the latter has such a high bending moment that a no or only a negligible bending of the infrastructure can take place and therefore eliminating the spring effect of the support layer.

3. Object of the Invention

It is the object of the invention to improve infrastructures of the aforementioned kind.

SUMMARY OF THE INVENTION

This object is achieved in generic infrastructures in that one of the frame halves is supported against a first lateral wall of a trough, while the other frame half is supported via a wedge, against the second lateral wall of a trough, the wedge can be tightened by screws, and the concrete plate can be produced on location from site-mixed concrete.

The production of the infrastructure of the invention takes place so that at first, the rails are aligned and then the trough is brought into the required position in relation to the rail. After that the elastic intermediate layers, the two frame halves and the wedge are inserted in the trough. Finally the plate consisting of concrete is produced from site-mixed concrete. As a result the production of the infrastructure is extremely simple. The soil or a casing can serve as a lateral limit for the site-mixed concrete, or the concrete plate can be produced through the sliding molding method.

In addition to the above the infrastructure of the invention has the following features:

It affords a durable and stable track support, thereby reducing maintenance costs;

It makes possible a simple disassembling and reassembling of the rail;

It provides an exceptional damping of air-transmitted and impact noise;

It makes possible an adjustment to small radii.

It prevents plant growth in track area, without the use of chemical agents or physical means;

It is maintenance free, since no small ironware is used;

It is secured against derailment; and

It is secured against vandalism.

The infrastructure of the invention allows a prestressing of the elastic padding provided between the rail and the two frame halves. At first, a certain preliminary stress is caused by the setting of the wedge. A further preliminary stress can be caused by using wedges of various width. Also inserting foils or thin plates between the wedge and the frame half bordering thereon can produce a further stress.

In the invention one of the frame halves is formed by the first lateral trough wall. This embodiment of the invention is particularly simple and can be used especially for rectilinear tracks, while the aforedescribed embodiment of the invention is provided especially for curves with small radii.

The trough can be made of sheet metal or of a section of any desired material. However it is advantageous to make the trough of a section of plastic material. Such a section of plastic material can be produced at very low cost.

Since the trough is not subjected to heavy loads, it requires only reduced wall thickness. According to a feature of the invention, the wall thickness of the trough ranges between 3 mm and 10 mm.

In order to afford sufficient stability to the trough, it is provided with reenforcement ribs on its outer surface.

In a further development of the invention, the trough is provided at its lower side with pipe segments, which serve for water evacuation from the space under the rail base. The pipe segments have either a length sufficient for this purpose, or hoses of corresponding length are attached onto the pipe segments. The pipe segments can be provided either on one side of the trough, or both trough sides.

It is possible to further improve the infrastructure of the invention by providing the trough with adapters for the attachment of connections for train safety or the like. This provides the mounting of continuous grounding rods and rail conductors, as well as—in the upper trough area—the attachment of mountings for the live rail and the cable lines. It is also possible to attach to the infrastructure other, or further grounding and live return current conductors, which are required for voltage equalization.

The two frame halves or at least one of the frame halves and/or the wedge can be made of any material , for instance of steel, plastic material, recycled plastic or high strength casting compound. Advantageously, however two frame halves, or one of the frame halves and the wedge are made of finished components made of concrete or plastic-coated concrete. The two frame halves, or at least one of the frame halves and the wedge can be also made of plastic reinforced with glass fibers or of recycled plastic material. Therefore the production of these parts is particularly simple and cost-effective.

The infrastructure of the invention is also suitable for the reconstruction of outdated track installations with gravel beds.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
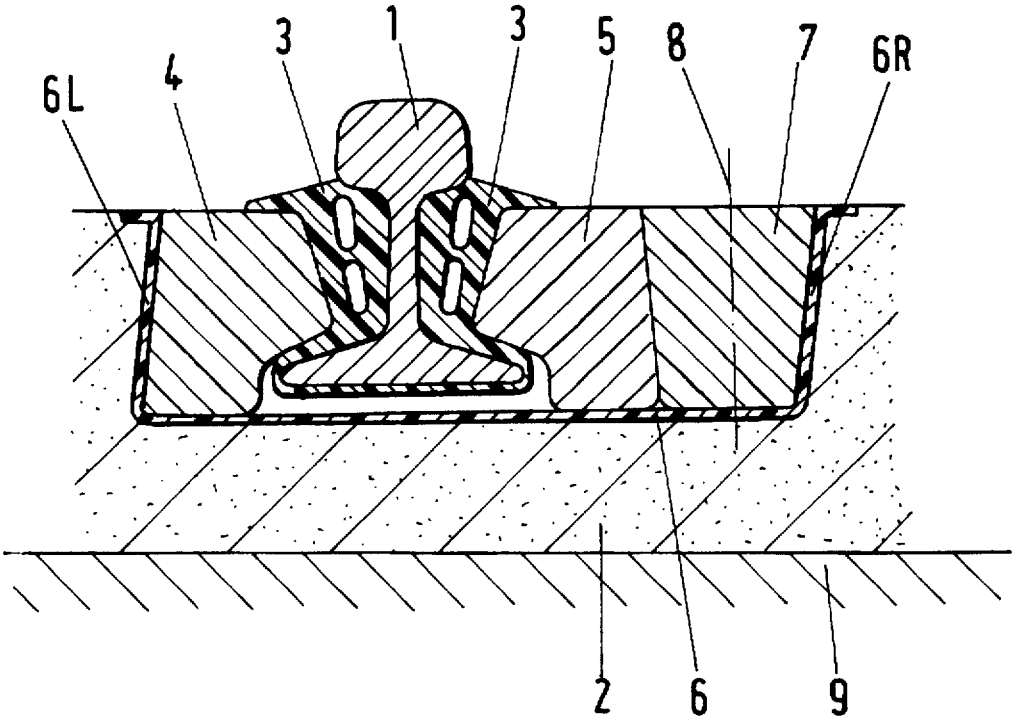
FIG. 1 is an infrastructure for a railway track with one of rails forming the track, in cross section.

The infrastructure shown in FIG. 1 has a rail 1 and plate 2 made of concrete, whereby the rail 1 is supported via an elastic intermediate layer 3 against the inner lateral limiting surface of a frame formed by two frame halves 4 and 5. The frame half 4 in turn rests against a first lateral wall 6L of a trough 6, while the other frame half 5 rests against the second lateral wall 6R of the trough, via a wedge 7 which has been tightened by means of a screw 8 indicated by a dash-dot line. The plate 2 consists of site-mixed concrete which has been poured into the space between the trough 6 and the foundation 9, after the alignment of rail 1, the subsequent mounting of the trough 6, of the elastic intermediate layer 3, of the two frame halves 4 and 5 as well as of the wedge 7.

Figure 2:
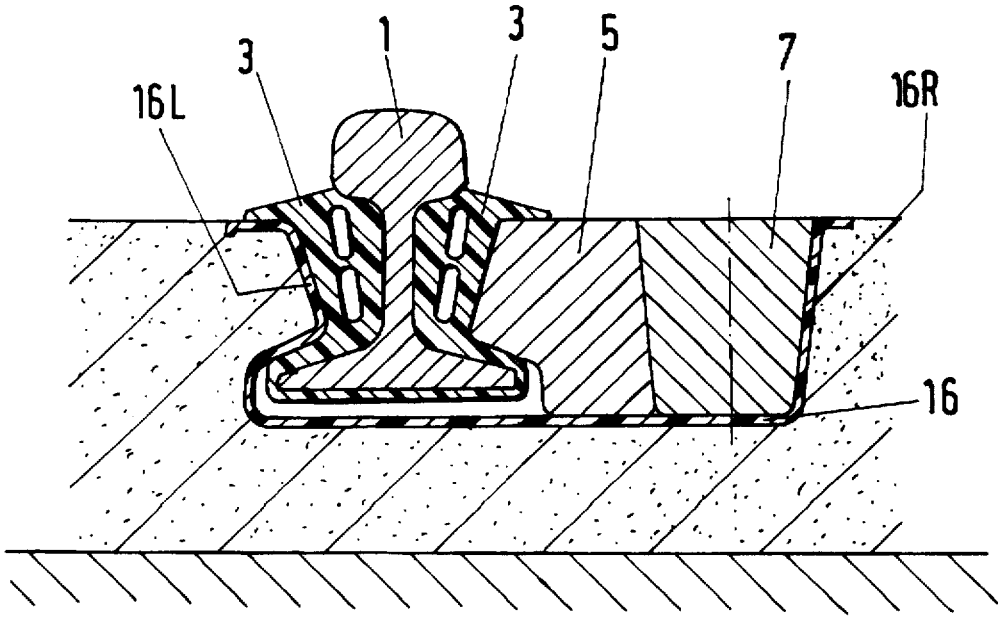
FIG. 2 is another infrastructure for a railway track with one of the rail forming the track, also in cross section.

In the infrastructure shown in FIG. 2 the one frame half—in the drawing the left frame half—is formed by the first lateral wall 16L of the trough 16. In this case the rail 1 is supported via the elastic intermediate layer 3 against the inner limiting surface of the first lateral wall 16L of the trough 16 and against the inner lateral limiting surface of the frame half 5, which in turn rests via the wedge 7 against the second lateral wall 16R of the trough 16.

Figure 3:
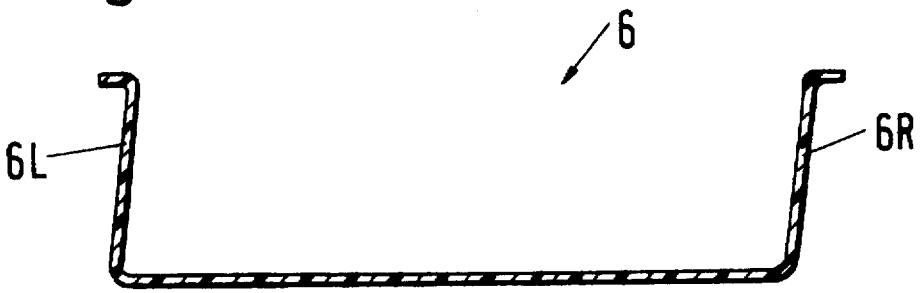
FIG. 3 is a trough for the infrastructure shown in FIG. 1 in cross section.

The shape of the cross section of trough 6 of the embodiment of the invention according to FIG. 1, with the two lateral wall 6L and 6R, can be seen in FIG. 3. The lateral walls 6L and 6R have the same inclination as the outer limiting surface of the frame half 4, or as the wedge 7 (FIG. 1).

Figure 4:
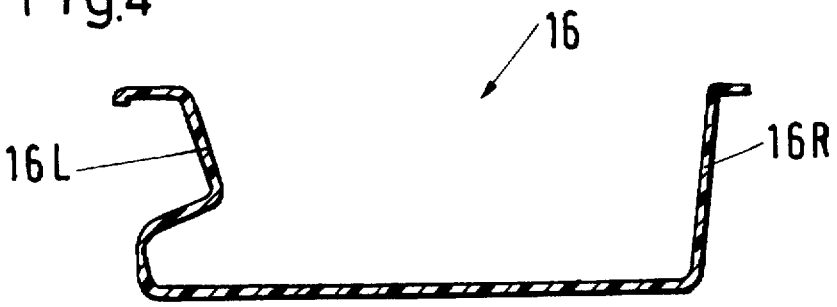
FIG. 4 is a trough for the infrastructure shown in FIG., 2, also in cross section.

FIG. 4 shows the shape of the cross section of the trough 16 of the embodiment example of the invention according to FIG. 2, whereby the lateral wall 16L forming one frame half is made to fit the contour of the elastic intermediate layer 3 (FIG. 2) resting thereagainst, while the second lateral wall 16R has the same inclination as the wedge 7 (FIG. 2).

Figure 5:
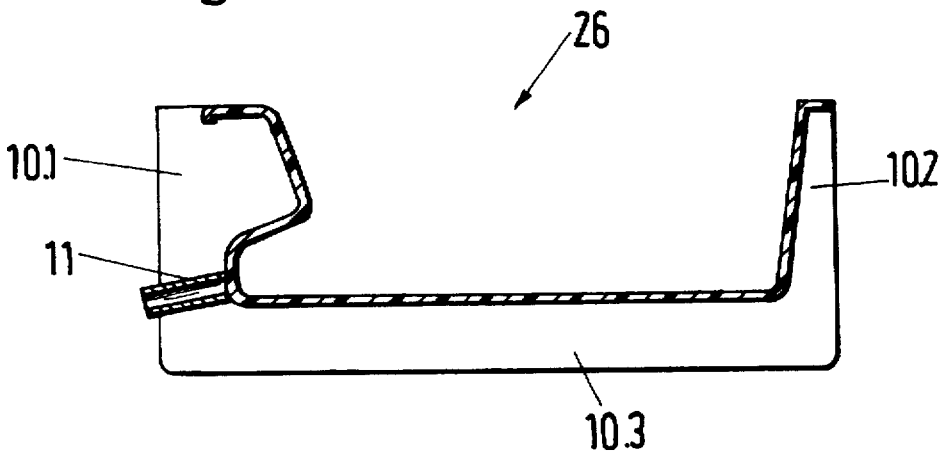
FIG. 5 is another trough for an infrastructure in cross section.

The trough 26 shown in FIG. 5 is provided with reinforcement ribs 10.1, 10.2, 10.3, which are arranged at intervals one after the other along an outer surface of the trough. Further in its lower area the trough 26 has pipe segments 11. Such pipe segments 11 can also be provided on both sides of the trough 26.

We claim:

1. An infrastructure for a railway track comprising:

a site-mixed concrete elongated plate; and a rail assembly received in said plate, said assembly comprising:

an elongated trough formed in the plate with opposite side walls;

a respective elongated rail received in the trough and spaced laterally inwardly from the side walls of the trough, the rail being formed with a pair of opposite flanks and a head atop the flanks, each of the flanks facing a respective one of the side walls and defining a respective compartment between the flank and the respective side wall;

a respective pair of elastic intermediate layers each received in the respective compartment underneath the head of the rail, each layer having respective outer and inner opposite lateral surfaces, the inner surface of each layer abutting the respective flank of the rail and the outer surface terminating at a distance from the respective side wall in the respective compartment;

a respective pair of frame halves each lying against the respective outer face of the respective layer and extending laterally toward the respective side wall of the trough, so that one of the frame halves abuts the respective side wall of the trough, the other frame half terminating at another distance from the respective side wall and forming a subcompartment therewith;

a wedge extending between and lying respectively against the side wall and the other frame half, thereby filling the subcompartment; and respective screwing means for tightening the wedge.

2. The infrastructure defined in claim 1 wherein the trough is made of plastic or metal.

3. The infrastructure defined in claim 1 wherein each of the side walls of the trough is from 3 to 10 mm thick.

4. The infrastructure defined in claim 1 wherein the trough is formed with an outer peripheral surface provided with a plurality of reinforcement ribs.

5. The infrastructure defined in claim 1 wherein the trough is provided with a drainage pipe.

6. The infrastructure defined in claim 1 wherein the wedge and at least one of the frame halves are made of finished concrete or plastic coated concrete.

7. The infrastructure defined in claim 1 wherein the wedge and at least one of the frame halves are made of finished components of plastic reinforced with glass fibers.

8. The infrastructure defined in claim 1 wherein the wedge and at least one of the frame halves are made of recycled plastic material.

9. An infrastructure for railway tracks laid upon a foundation, comprising:

a site-mixed concrete elongated plate; and a rail assembly received in said plate, said assembly comprising:

an elongated trough formed in the plate with opposite side walls;

a rail received in the trough and spaced laterally inwardly from the side walls of the trough, the rail being formed with a pair of opposite flanks and a head atop the flanks, each of the flanks facing a respective one of the side walls and defining a respective compartment therebetween;

at least one respective elastic intermediate layer received in one of the compartments underneath the head of the rail and formed with an inner lateral surface abutting the respective flank of the rail and extending laterally outwardly therefrom toward the respective side wall of the trough, the one layer terminating at a distance from the respective side wall in the respective compartment;

a frame having an outer lateral face and an inner lateral face which lies against the one layer, the outer lateral face being spaced laterally inwardly from the respective side wall and forming a subcompartment therewith;

a wedge in said subcompartment extending between and lying respectively against the side wall and the outer lateral face of the frame, thereby filling the subcompartment;

means for filling the other compartment; and screwing means for tightening the wedge.

10. The infrastructure defined in claim 9 wherein the means for filling the other compartment includes another elastic layer received in the other compartment and lying between and against the respective side wall of the trough and the respective flank of the rail.

11. The infrastructure defined in claim 9 wherein the means for filling the other compartment includes:

another elastic layer extending laterally outwardly from the respective flank of the rail and terminating at a distance from the respective side wall of the trough; and another frame lying between and against the other layer and the respective side wall of the trough.

12. A method for forming an infrastructure for railway tracks laid upon a foundation, comprising the steps of:

forming an upwardly directed channel on said foundation;

assembling a pair of identical rail assemblies in said channel, each of the assemblies being formed by the following steps:

receiving a respective elongated rails in said channel, bringing a respective trough under the rail, thereby forming a respective pair of compartments defined between respective flanks of the rail and side walls of the trough, filling a one of the pair of compartments with respective means for filling up the one compartment, receiving a respective elastic layer abutting a flank of the rail in the other compartment, the elastic layer extending laterally outwardly toward the respective side wall of the trough, receiving a respective frame abutting the elastic layer and terminating at a distance from the respective side wall of the trough in the other compartment, and receiving a respective wedge lying against the frame and the side wall of the trough in the other compartment, thereby completing the respective assembly;

aligning the pair of assemblies so that the rails extend in a laterally spaced apart parallel relationship for in indefinite length in said channel; and thereafter filling said channel with a site-mixed concrete around said troughs, thereby forming a sleeper.

* * * * *